US010398994B1

(12) United States Patent
Cumings et al.

(10) Patent No.: US 10,398,994 B1
(45) Date of Patent: Sep. 3, 2019

(54) TOY EGG INCUBATING AND HATCHING SYSTEM INCLUDING A MONSTER INSIDE THE EGG

(71) Applicants: Mark Cumings, Indianapolis, IN (US); Hanna Cumings, Lecanto, FL (US)

(72) Inventors: Mark Cumings, Indianapolis, IN (US); Hanna Cumings, Lecanto, FL (US)

( * ) Notice: Subject to any disclaimer, the term of this patent is extended or adjusted under 35 U.S.C. 154(b) by 0 days.

(21) Appl. No.: 15/935,247

(22) Filed: Mar. 26, 2018

(51) Int. Cl.

| | |
|---|---|
| ***A63H 3/50*** | (2006.01) |
| ***A63H 33/26*** | (2006.01) |
| ***A63H 13/02*** | (2006.01) |
| ***G09F 19/08*** | (2006.01) |

(52) U.S. Cl.
CPC ..... *A63H 13/02* (2013.01); *A63H 3/50* (2013.01); *A63H 33/26* (2013.01); *G09F 19/08* (2013.01)

(58) Field of Classification Search
CPC ..... A63H 3/00; A63H 3/50; A63H 33/00; A63H 33/003; A63H 33/26; A63H 33/42; G09F 19/08
See application file for complete search history.

(56) References Cited

U.S. PATENT DOCUMENTS

| | | | | |
|---|---|---|---|---|
| 2,836,931 | A * | 6/1958 | Brennan | A63H 13/02 446/132 |
| 4,807,377 | A * | 2/1989 | Stuckel | A47G 1/14 40/711 |
| 5,471,891 | A * | 12/1995 | Chen | G10F 1/06 40/455 |
| 6,231,346 | B1 * | 5/2001 | Sagi-Dolev | G09B 19/00 434/225 |
| 2004/0150993 | A1 * | 8/2004 | McElhaney | A63H 5/00 362/249.12 |
| 2007/0186864 | A1 * | 8/2007 | Bae | A01K 41/00 119/319 |
| 2014/0174038 | A1 * | 6/2014 | Weder | B65D 11/02 53/468 |

* cited by examiner

*Primary Examiner* — John A Ricci
(74) *Attorney, Agent, or Firm* — The Iwashko Law Firm, PLLC; Lev Ivan Gabriel Iwashko

(57) ABSTRACT

An egg incubator system to house a toy egg thereinside, the egg incubator system including a base, including a surface, a turntable disposed on a center of the surface to hold the egg within a divot on the turntable, a motor to cause the turntable to turn or shake, a dome disposed over the base to encase the egg therein, and a toy monster disposed within the egg.

7 Claims, 5 Drawing Sheets

TOY EGG INCUBATING AND HATCHING SYSTEM INCLUDING A MONSTER INSIDE THE EGG

BACKGROUND

1. Field

The present general inventive concept relates generally to a toy egg incubating and hatching system, and particularly, to a toy egg incubating and hatching system including a monster inside the egg.

2. Description of the Related Art

Currently, there are no collectible hatchable toys related to 16th century alchemy on the market. Hatching toys, as a category, are typically designed for young girls, eliminating the possibility of use by boys.

Therefore, there is a need for hatching toys that will appeal to all genders.

SUMMARY

The present general inventive concept provides a toy egg incubating and hatching system including a monster inside the egg.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an egg incubator system to house a toy egg thereinside, the egg incubator system including a base, including a surface, a turntable disposed on a center of the surface to hold the egg within a divot on the turntable, a motor to cause the turntable to turn or shake, a dome disposed over the base to encase the egg therein, and a toy monster disposed within the egg.

The toy monster may be extracted from the egg in response to a shell of the egg being cracked and broken to expose the toy monster.

The egg incubator system may further include a wand having a magnetic tip.

The magnetic tip may cause movement of the at least one of a head, arms, and legs of the toy monster when the magnetic tip passes over the at least one of the head, arms, and legs of the toy monster.

The at least one of the head, arms, and legs of the toy monster may be either magnetized or include ball bearings disposed therewithin.

The egg incubator system may further include at least one light disposed on the surface of the base to selectively illuminate the egg.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Figure 1:
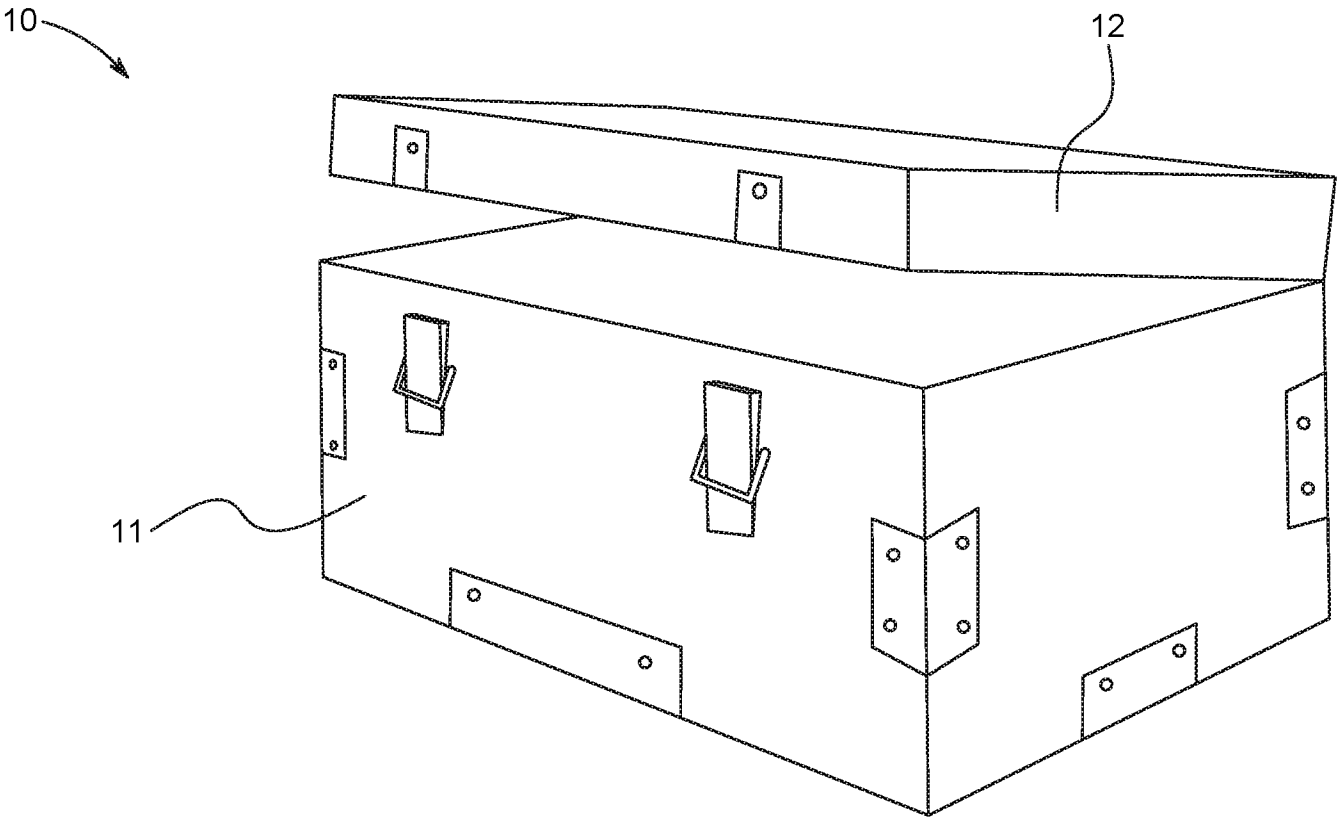
FIG. 1 illustrates a box, according to an exemplary embodiment of the present general inventive concept.

FIG. 1 illustrates a box 10, according to an exemplary embodiment of the present general inventive concept.

The box 10 may be constructed from wood, metal, plastic, rubber, or any other material known to one of ordinary skill in the art.

The box 10 may have an appearance of an ancient alchemist box, a decorative Japanese box, an old English chest, or any other type of box that is decorative and interesting.

The box 10 may include a body 11 and a lid 12, which may open and close with respect to the body.

The box 10 may house various items and objects therein.

Figure 2:
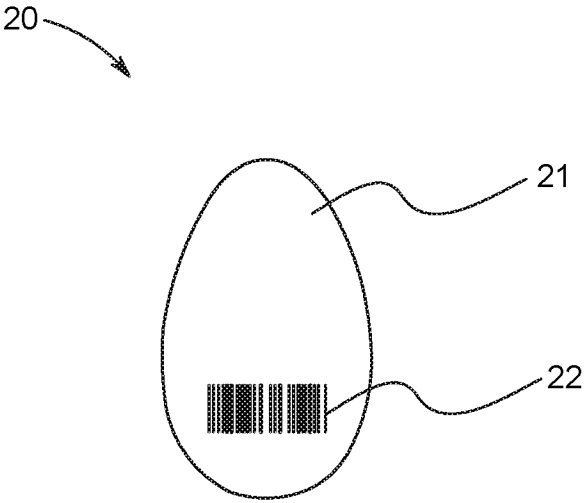
FIG. 2 illustrates an egg, according to an exemplary embodiment of the present general inventive concept.

FIG. 2 illustrates an egg 20, according to an exemplary embodiment of the present general inventive concept.

The egg 20 may be constructed from calcium, plastic, wood, or any other material known to one of ordinary skill in the art, which is breakable by a user.

The egg 20 may include a shell 21 and a barcode 22. The shell 21 may be breakable, such that it houses an object or item thereinside. The barcode 22 may be a unique barcode that identifies the egg 20 as a particular collector's item. The barcode 22 may also identify what type of object is housed within the egg 20.

Figure 3:
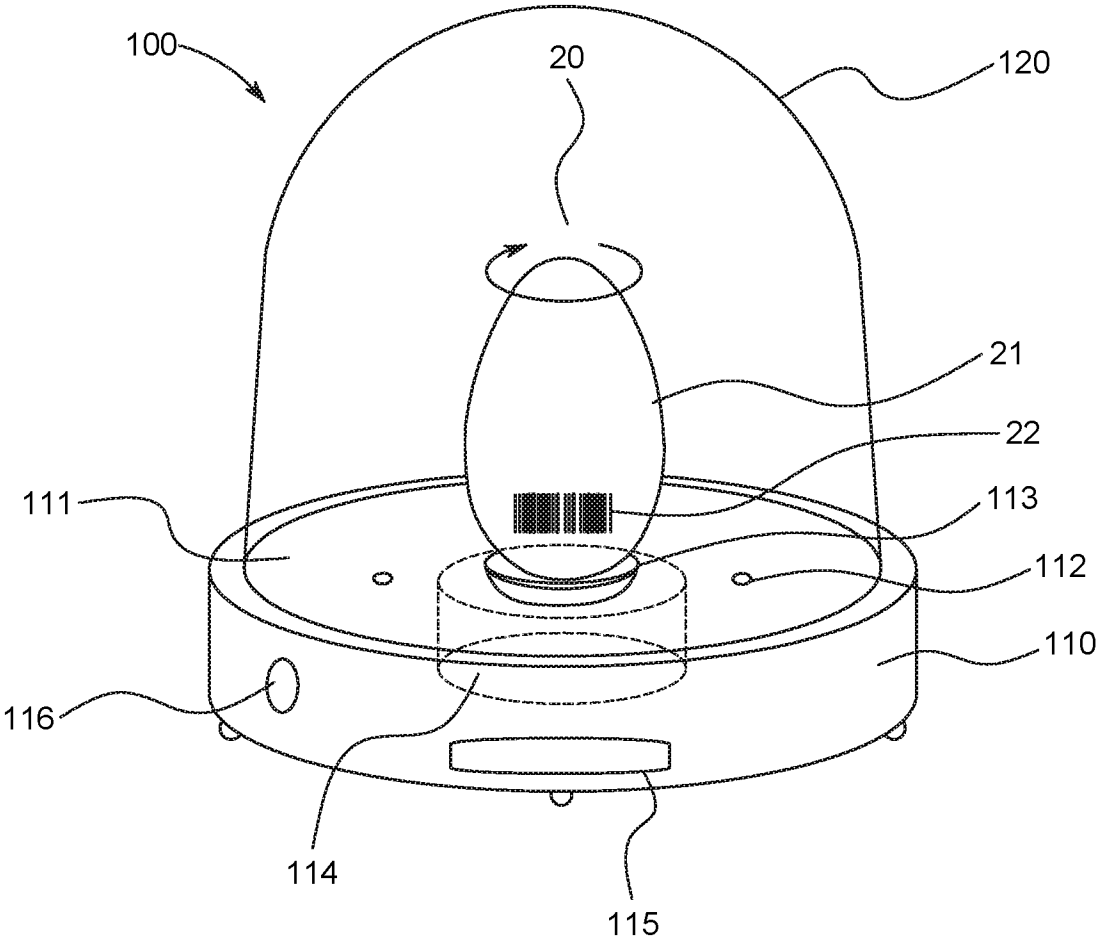
FIG. 3 illustrates an egg incubating system, according to an exemplary embodiment of the present general inventive concept.

FIG. 3 illustrates an egg incubating system 100, according to an exemplary embodiment of the present general inventive concept.

The egg incubating system 100 may include a base 110 and a dome 120, and may store the egg 20 thereinside between the base 110 and the dome 120.

The base 110 may include a surface 111, at least one light 112, a turntable 113, a motor 114, a battery 115, and a button 116, but is not limited thereto.

The at least one light 112 may be disposed on the surface 111, and may include a light having any color, including, but not limited to red, white, yellow, blue, green, etc. The at least one light 112 may be a light emitting diode, a halogen light, an incandescent light, and a fluorescent light, but is not limited thereto. As such, when the at least one light 112 is powered on and red in color, the egg 20 may be illuminated to give the user an impression that the egg 20 is being heated and/or incubated.

The turntable 113 may be disposed at a center portion of the surface 111. The turntable 113 may have a round shape and a divot to allow the egg 20 to remain disposed upright thereupon.

The motor 114 may be disposed within the base 110, underneath the surface 111. The motor 114 may function to move the turntable 113. More specifically, the motor 114 may cause the turntable 113 to turn and/or shake.

The battery 115 may be a rechargeable battery, alkaline battery, lithium battery, or any other battery known to one of ordinary skill in the art. The battery 115 may provide power to the at least one light 112 and/or to the motor 114.

The button 116 may be a button or a switch that allows the battery 115 to provide power to the at least one light 112 and/or to the motor 114 when the button 116 is pressed or switched. The button 116 may also be provided in plurality such that the at least one light 112 and the motor 114 may be independently controlled.

Also, a computer and/or processor may be included within the base 110, such that the turntable 113 may turn and/or shake based on predetermined and/or preprogrammed times.

The dome 120 may be constructed from plastic, glass, or any other transparent, semi-transparent, and/or opaque material known to one of ordinary skill in the art. However, preferably, the dome 120 may be transparent to allow a user to view the egg 20 housed therewithin.

The dome 120 may be disposed over the base 110 to encase the egg 20 therein.

The dome 120 may also help distribute light emitted from the at least one light 112, such that the at least one light 112 fully shines on the egg 20 to give the impression that the egg 20 is being incubated.

During "incubation," the at least one light 112 may be red, and the turntable 113 may turn, thus rotating the egg 20.

The at least one light 112 may turn green at a predetermined time, and as a result, the turntable 113 may begin to shake, denoting that the egg 20 is "ready" to be cracked open.

Figure 4:
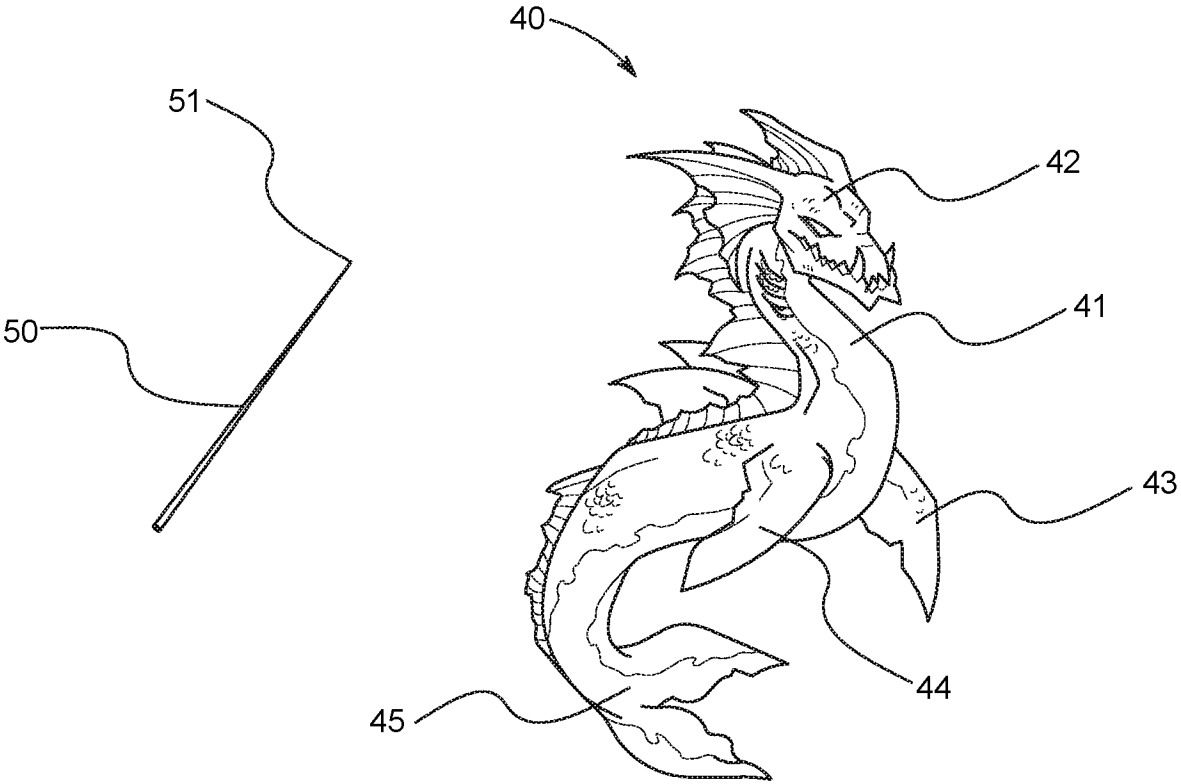
FIG. 4 illustrates a monster and a wand, according to an exemplary embodiment of the present general inventive concept.

FIG. 4 illustrates a monster 40 and a wand 50, according to an exemplary embodiment of the present general inventive concept.

The monster 40 may be a toy monster disposed within the egg 20, and may be extracted from the egg 20 when the user breaks the shell 21 of the egg 20.

The monster 40 may include magnetized appendages, such as a magnetic head 41, a magnetic left arm 43, a magnetic right arm 44, and a magnetic tail 45 (or magnetic feet 45).

The monster 40 may have a myriad of different shapes and features, and may include combinations of various homunculus-type creatures, including, but not limited to, dragons, fish, lizards, spiders, wolves, lions, insects, angels, demons, cephalopods, unicorns, etc.

The monster 40 may be constructed from polyvinyl chloride, plastic, metal, wood, rubber, or any other material known to one of ordinary skill in the art.

The wand 50 may include a magnetic tip 51.

Therefore, when the user waves the wand 50 over the monster 40, the magnetized appendages, such as the magnetic head 41, the magnetic left arm 43, the magnetic right arm 44, and the magnetic tail 45, may react to the magnetic tip 51 as the wand 50 passes over the respective appendage. In other words, magnetic tip 51 may cause the magnetic head 41, the magnetic left arm 43, the magnetic right arm 44, and/or the magnetic tail 45 to move.

Alternatively, the appendages 41 through 45 may include small ball bearings therewithin instead of being magnetized, so they still react and move to the magnetized tip 51 of the wand 50.

Figure 5:
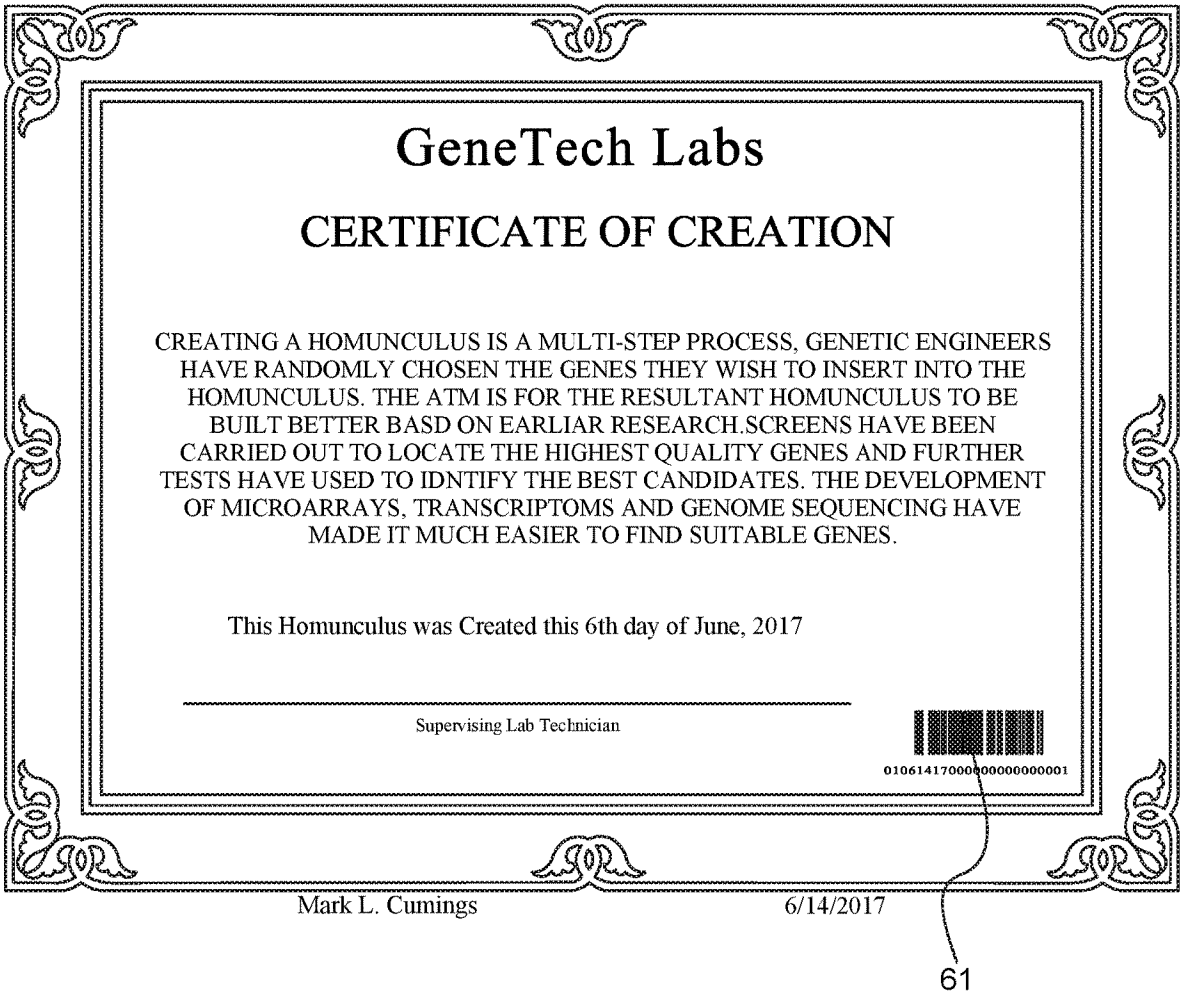
FIG. 5 illustrates a certificate, according to an exemplary embodiment of the present general inventive concept.

FIG. 5 illustrates a certificate 60, according to an exemplary embodiment of the present general inventive concept.

The certificate 60 may be a certificate of creation or authenticity, and may include a barcode 61 to denote which type of monster 40 is stored within the egg 20.

The monster 50 may also be called a "Pet Homunculus."

The Pet Homunculus provides optional habitats for the creature, allowing for the creation of connecting various habitats and for users to utilize their imagination and enhance their creativity when engaging with the pet. Finally, instructions inside the kit may give a history lesson on 16th century alchemy in comparison to present day genetic manipulation and splicing. The Pet Homunculus is ultimately a great way to promote education while also serving as an entertaining product.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. An egg incubator system to house a toy egg thereinside, the egg incubator system comprising:

a base, comprising:

a surface, a turntable disposed on a center of the surface to hold the egg within a divot on the turntable, and a motor to cause the turntable to turn or shake;

a dome disposed over the base to encase the egg therein; and a toy monster disposed within the egg.

2. The egg incubator system of claim 1, wherein the toy monster may be extracted from the egg in response to a shell of the egg being cracked and broken to expose the toy monster.

3. The egg incubator system of claim 1, further comprising:

a wand having a magnetic tip.

4. The egg incubator system of claim 3, wherein the magnetic tip causes movement of at least one of a head, arms, and legs of the toy monster when the magnetic tip passes over the at least one of the head, arms, and legs of the toy monster.

5. The egg incubator system of claim 4, wherein the at least one of the head, arms, and legs of the toy monster are either magnetized or include ball bearings disposed therewithin.

6. The egg incubator system of claim 1, further comprising:

at least one light disposed on the surface of the base to selectively illuminate the egg.

7. An egg incubator system to house a toy egg thereinside, the egg incubator system comprising:

a base, comprising:

a surface, a turntable disposed on a center of the surface to hold the egg within a divot on the turntable, a motor to cause the turntable to turn or shake, and a processor disposed within the base to activate the motor based on at least one of a predetermined time and a preprogrammed time;

a dome disposed over the base to encase the egg therein; and a barcode disposed on a portion of an outer surface of the egg to identify a type of object housed within the egg.

* * * * *